US011143138B2

(12) United States Patent
Dietrich et al.

(10) Patent No.: US 11,143,138 B2
(45) Date of Patent: Oct. 12, 2021

(54) THERMALLY INSULATED AIR INLET SYSTEM FOR AN INTERNAL COMBUSTION ENGINE

(71) Applicant: MAN Truck & Bus AG, Munich (DE)

(72) Inventors: Jens Dietrich, Heilsbronn (DE); Thomas Malischewski, Heilsbronn (DE); Marco Tilinski, Röthenbach A. D. Pegnitz (DE); Steffen Hirschmann, Neustadt an der Aisch (DE)

(73) Assignee: MAN TRUCK & BUS AG, Munich (DE)

( * ) Notice: Subject to any disclaimer, the term of this patent is extended or adjusted under 35 U.S.C. 154(b) by 79 days.

(21) Appl. No.: 15/981,345

(22) Filed: May 16, 2018

(65) Prior Publication Data

US 2018/0340490 A1 Nov. 29, 2018

(30) Foreign Application Priority Data

May 23, 2017 (DE) ..... 102017111262.6

(51) Int. Cl.
*F02B 77/11* (2006.01)
*F02F 1/42* (2006.01)
(Continued)

(52) U.S. Cl.
CPC ..... *F02F 1/4257* (2013.01); *F02M 35/104* (2013.01); *F02M 35/10052* (2013.01);
(Continued)

(58) Field of Classification Search
CPC ..... F02F 1/4257; F02F 2200/06; F02M 35/10052; F02M 35/10072;
(Continued)

(56) References Cited

U.S. PATENT DOCUMENTS 3,667,432 A 6/1972 Greathouse
4,207,660 A * 6/1980 Rao ..... B23P 15/00 123/193.5
(Continued)

FOREIGN PATENT DOCUMENTS

CN 1606657 A 4/2005
CN 101089447 A 12/2007
(Continued)

OTHER PUBLICATIONS

JP 2013189960 A—English Translation.*
(Continued)

*Primary Examiner* — George C Jin
*Assistant Examiner* — Teuta B Holbrook
(74) *Attorney, Agent, or Firm* — Weber Rosselli & Cannon LLP

(57) ABSTRACT

The disclosure relates to an air inlet system for an internal combustion engine. The air inlet system has a cylinder head having an inlet channel for introducing inlet air into a combustion chamber of the internal combustion engine. The air inlet system has an air supply pipe piece, which is connected to the cylinder head and which at least partially forms an air supply channel, which opens in the inlet channel. The air inlet system additionally has thermal insulation, which is arranged in the air supply channel in order to reduce a heat transfer to the inlet air which flows in the air supply channel.

19 Claims, 5 Drawing Sheets

(51) Int. Cl.
*F02M 35/10* (2006.01)
*F02M 35/12* (2006.01)
*F02M 35/104* (2006.01)

(52) U.S. Cl.
CPC *F02M 35/10072* (2013.01); *F02M 35/10268* (2013.01); *F02M 35/10347* (2013.01); *F02M 35/1272* (2013.01); *F02F 2200/06* (2013.01)

(58) Field of Classification Search
CPC ..... F02M 35/10268; F02M 35/10347; F02M 35/104; F02M 35/1272
USPC ..... 123/193.5; 29/888.061
See application file for complete search history.

(56) References Cited

U.S. PATENT DOCUMENTS 4,300,494 A * 11/1981 Graiff ..... F02B 77/11 123/193.5
4,398,527 A * 8/1983 Rynbrandt ..... F02B 77/04 123/668
4,471,017 A * 9/1984 Poeschel ..... C23C 4/02 123/193.5
4,743,481 A * 5/1988 Quinlan ..... B29C 33/123 264/221
5,031,401 A 7/1991 Hinderks
5,099,808 A * 3/1992 Matsuura ..... F02F 1/4228 123/188.14
5,245,955 A * 9/1993 Husted ..... B29C 37/0082 123/184.61
5,535,718 A * 7/1996 Nakai ..... F02B 61/045 123/336
5,552,196 A * 9/1996 Haselkorn ..... F02B 77/11 138/146
5,842,342 A * 12/1998 Strasser ..... C04B 35/80 60/282
7,360,512 B1 * 4/2008 Asmus ..... F02F 1/40 123/310
7,757,808 B1 * 7/2010 Vaz ..... F01N 1/02 123/184.57
2002/0168492 A1 * 11/2002 Madono ..... C03C 25/42 428/36.91
2004/0099238 A1 * 5/2004 Gould ..... F02F 1/24 123/193.5
2004/0226536 A1 * 11/2004 Sakai ..... F02F 1/38 123/308
2005/0269727 A1 * 12/2005 Aisenbrey ..... B29C 45/0013 264/104
2007/0079920 A1 * 4/2007 Holland ..... B29C 73/10 156/98
2008/0110430 A1 * 5/2008 Ogawa ..... F02D 9/1035 123/184.61
2008/0141921 A1 * 6/2008 Hinderks ..... B63B 1/28 114/274
2009/0026010 A1 * 1/2009 Saito ..... B29C 44/005 181/290
2009/0314242 A1 * 12/2009 Ishihara ..... F02D 9/1035 123/184.56
2010/0294228 A1 * 11/2010 Kameda ..... F02B 31/08 123/184.56
2012/0273301 A1 * 11/2012 Jones ..... F01N 1/08 181/228
2013/0195620 A1 * 8/2013 Joergl ..... F01N 13/105 415/116
2015/0040879 A1 * 2/2015 Tomita ..... F16J 1/01 123/668
2015/0275818 A1 * 10/2015 Fujimoto ..... F02D 41/0025 60/285
2016/0108753 A1 * 4/2016 Tran ..... C09D 183/04 415/1
2017/0058793 A1 * 3/2017 Harada ..... F02M 45/12
2017/0248099 A1 * 8/2017 Wagner ..... F02F 3/14
2020/0049059 A1 * 2/2020 Ikeya ..... F02B 31/08

FOREIGN PATENT DOCUMENTS

CN 201116776 9/2008
CN 101432510 A 5/2009
DE 4006583 A1 9/1990
DE 102007045634 A1 * 4/2009 ..... F02M 35/10321
DE 102007045634 A1 4/2009
DE 112011102910 T5 6/2013
FR 2145340 A5 2/1973
FR 2611809 A1 9/1988
FR 2715972 A1 8/1995
FR 2907514 A3 * 4/2008 ..... F02M 35/10085
GB 1473168 A 5/1977
JP s5486014 A 7/1979
JP 59209831 A * 11/1984 ..... B29C 33/68
JP 2013189960 A * 9/2013 ..... F02B 23/00
JP 2016118132 A 6/2016

OTHER PUBLICATIONS

Notification of the First Office Action issued in Chinese Application No. 201810499532.2 dated May 25, 2021, with English translation.

* cited by examiner

THERMALLY INSULATED AIR INLET SYSTEM FOR AN INTERNAL COMBUSTION ENGINE

BACKGROUND

Fresh air for combustion of the fuel is supplied to the combustion chambers of an internal combustion engine via an air inlet system. The air inlet system has different air flow channels. This includes the inlet channel in the cylinder head, which opens in the combustion chamber. Upstream of the inlet channel there is arranged an air supply channel which, for example, can distribute the inlet air to one or more cylinders. The air inlet system may have additional components, such as, for example, a compressor and a charge air cooler.

During operation of the internal combustion engine, the internal combustion engine becomes heated. In particular, the cylinder head which is mounted on the combustion chambers becomes heated. It is desirable for the inlet air when flowing into the combustion chambers to have a low temperature and consequently a high density. The inlet air may, for example, become heated during compression by a compressor or by means of a heat transfer from the cylinder head which is heated during operation.

U.S. Pat. No. 4,300,494 A discloses an Otto engine with reduced fuel consumption. The internal combustion engine has an inlet channel in the cylinder head which is coated with a thermally insulating material.

DE 40 06 583 A1 discloses a diesel engine. A suction channel in the cylinder head of the diesel engine is provided with a thermally insulating lining which comprises a ceramic material.

JP2016118132 (A) discloses a thermal insulating element for a suction channel in a cylinder head of an internal combustion engine.

The known measures may be inadequate so that the fresh air still flows with an excessively high temperature into the combustion chambers of the internal combustion engine.

SUMMARY

The present disclosure relates to an air inlet system for an internal combustion engine and method for producing an air inlet system. An object of the disclosure is therefore to provide an air inlet system which enables the supply of cool fresh air to the combustion chambers of an internal combustion engine.

The air inlet system has a cylinder head having an inlet channel for introducing inlet air into a combustion chamber of the internal combustion engine. The air inlet system further has an air supply pipe piece which is connected to the cylinder head and which at least partially forms an air supply channel which opens in the inlet channel. Additionally, thermal insulation is arranged in the air supply channel in order to reduce a heat transfer to the inlet air which flows in the air supply channel. By arranging the thermal insulation, a heating of the inlet air when flowing through the air supply channel can be reduced. As a result of the reduced heating of the inlet air, the density of the inlet air is not significantly reduced. Consequently, more inlet air can flow into the combustion chamber. This may increase the degree of efficiency of the internal combustion engine and consequently assist in consuming less fuel.

The air supply pipe piece can be constructed as an air distribution pipe piece for distributing the inlet air over a plurality of cylinders of the internal combustion engine.

Further, the air supply channel may be arranged upstream of the inlet channel. The thermal insulation may be in abutment with an inner wall face of the air supply channel. The air supply pipe piece may have an open profile, for example, a U-shaped profile.

The thermal insulation may be produced from a material which is resistant to exhaust gases so that, for example, in embodiments with exhaust gas recirculation, there is no impairment of the thermal insulation as a result of the exhaust gas. The air inlet system may have a compressor and/or a charge air cooler upstream of the air supply pipe piece. The cylinder head may be a single-cylinder cylinder head or a multi-cylinder cylinder head.

In a construction variant, the air supply pipe piece and the thermal insulation are produced from different materials. The air supply pipe piece may in particular be produced from a metal alloy, preferably an aluminium alloy. Alternatively or additionally, the thermal insulation may be produced in particular from a plastics material, a rubber and/or a silicone. Consequently, the air supply pipe piece may, for example, be produced from a load-bearing metal alloy which has a high thermal conductivity. In contrast, the thermal insulation may be produced from a material which has a low thermal conductivity.

In particular, the thermal insulation may have a thermal conductivity which is less than a thermal conductivity of an outer wall of the air supply pipe piece.

In another construction variant, the thermal insulation has a thermal conductivity less than 1 W/(m·K), in particular less than 0.5 W/(m·K), preferably less than 0.1 W/(m·K). Consequently, a heat transfer to the inlet air flowing in the air supply channel can be significantly reduced.

In an embodiment, the air supply pipe piece is mounted on the cylinder head, in particular screwed on. Alternatively, the air supply pipe piece and the cylinder head are constructed integrally with each other from one piece and in particular form an integral cast component. The proposed thermal insulation can consequently be used both in embodiments with a mounted air supply pipe piece and in embodiments with a cast air supply pipe piece.

In another embodiment, the thermal insulation has an inlay, in particular a liner. The inlay abuts an inner wall face of the air supply channel. In addition, the inlay may in particular have an adhesive layer for adhesively bonding the inlay to the inner wall face of the air supply channel.

In a development, the inlay is constructed as a flexible, in particular foldable, inlay. This can facilitate an assembly of the inlay in the air supply channel.

In an advantageous development, the inlay is produced by means of a 3D printing method. Consequently, complex geometry and filigree structures of the inlay for reproducing an inner contour of the air supply channel with an acceptable level of complexity can also be produced.

Advantageously, the inlay additionally acts as a seal on a transition between the cylinder head and the air supply pipe piece. In particular in embodiments in which the air supply pipe piece is mounted on the cylinder head, a seal between the air supply pipe piece and the cylinder head can be improved by the inlay.

In an embodiment, the thermal insulation has a coating. The coating is applied to an inner wall face of the air supply channel. For example, the coating may be applied by an injection method. The coating may be provided alternatively or additionally to the inlay (liner). The coating and the inlay may be provided beside each other or one above the other.

In a development, the thermal insulation is additionally or alternatively constructed to damp a suction noise which occurs during operation of the internal combustion engine in the air suction channel and/or to acoustically insulate the suction channel. To this end, the thermal insulation may, for example, be constructed to bring about a (for example, increased or considerable) reflection of the air noise in the air suction channel (insulation) or to reduce a sound intensity by means of absorption (damping). This may in particular lead to a noise which is perceived outside the air supply pipe piece being reduced in terms of volume and/or changed in a frequency range. The acoustic effect may in particular be brought about by a shape and/or a material/material mix of the thermal insulation.

In another embodiment, the thermal insulation is additionally arranged in the inlet channel of the cylinder head. The thermal insulation in the inlet channel may have a coating of an inner wall face of the inlet channel and/or an inlay which abuts the inner wall face and which is in particular flexible, preferably foldable, for example, a liner. This has the advantage that a heating of the inlet air can be reduced not only in the air supply channel, but also in the inlet channel.

The inlet channel is in particular curved. The inlet channel opens in the direction towards the combustion chamber. A combustion chamber opening of the inlet channel may be able to be closed by a globe valve (disc valve).

The air supply channel may extend in a substantially linear manner. The air supply channel (the air supply pipe piece) may in particular extend along a row of cylinders of the internal combustion engine which are arranged beside each other.

The air supply channel may be constructed as an air supply distribution channel with a plurality of outlets for a plurality of inlet channels. The inlet channels may lead to the same or in particular to a plurality of combustion chambers of the internal combustion engine.

The air supply pipe piece is in particular constructed as a load-bearing element and/or as a cast component, preferably a cast metal component, for mounting one or more components of the internal combustion engine.

In an embodiment, the cylinder head partially forms the air supply channel. The cylinder head forms in particular an outlet region of the air supply channel which opens in the inlet channel. Alternatively, the air supply pipe piece completely forms the air supply channel.

The wall thickness of the thermal insulation may be selected in such a manner that adequate thermal insulation of the inlet air in the air supply channel is ensured. The wall thickness of the air supply pipe piece may be selected in such a manner that a load-bearing function of the air supply pipe piece is ensured.

In another embodiment, the thermal insulation and the air supply pipe piece define a common wall thickness of the air supply channel. The thermal insulation has a wall thickness in a range less than 50% of the common wall thickness, in particular between 30% and 40% of the common wall thickness. Consequently, on the one hand, good thermal insulation can be achieved and, on the other hand, a load-bearing function of the air supply pipe piece can be enabled.

The thermal insulation may, for example, have a thickness of approximately 3 mm, preferably less than 3 mm.

The disclosure further relates to a motor vehicle, in particular a utility vehicle, having an air inlet system as disclosed herein.

The disclosure additionally relates to a method for producing an air inlet system of an internal combustion engine. The method involves the casting of a cylinder head having an inlet channel and a cast air supply pipe piece. The air supply pipe piece forms with the cylinder head an air supply channel which opens in the inlet channel. The inlet channel has a combustion chamber opening and the air supply channel has an inlet opening for inlet air. The method further involves the introduction of thermal insulation which has a folded inlay, in particular a liner, through the combustion chamber opening or the inlet opening into the air supply channel. The method additionally involves unfolding the inlay in the air supply channel so that the inlay is in abutment with an inner wall face of the air supply channel. Consequently, thermal insulation may be arranged in a cast air supply pipe piece.

In addition, the disclosure relates to an additional method for producing an air inlet system of an internal combustion engine. The method involves casting an air supply pipe piece for mounting on a cylinder head. The air supply pipe piece can be mounted in such a manner that an air supply channel which is at least partially formed by the air supply pipe piece opens in an inlet channel of the cylinder head. The method involves coating an inner wall face of the air supply channel with a coating as thermal insulation. Alternatively or additionally, the method may involve placing or introducing an inlay, in particular a liner, as thermal insulation in the air supply channel. The method additionally involves mounting the air supply pipe piece on the cylinder head. Consequently, thermal insulation can be arranged in different manners in a mounted air supply pipe piece.

The mounting of the air supply pipe piece may in particular take place before the introduction of the inlay, after the placement of the inlay or after the coating of an inner wall face. The inlay may, for example, be introduced in a folded state into the air supply channel through an inlet opening of the air supply channel or a combustion chamber opening of the inlet channel and may be unfolded in the air supply channel. The methods for producing an air inlet system can produce the air inlet system disclosed herein.

The above-described embodiments and features of the disclosure can be freely combined with each other.

BRIEF DESCRIPTION OF THE DRAWINGS

Further details and advantages of the disclosure are described below with reference to the appended drawings, in which.

The embodiments shown in the Figures at least partially correspond so that similar or identical components are provided with the same reference numerals and, for the explanation thereof, reference may also be made to the description of the other embodiments or Figures in order to prevent repetition.

DETAILED DESCRIPTION

Figure 1:
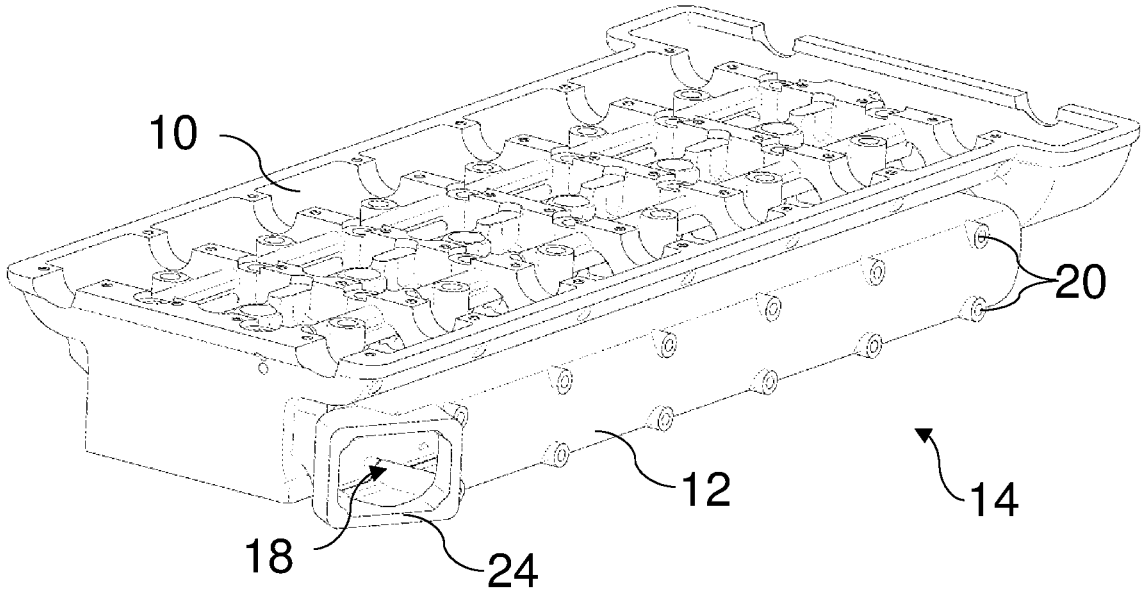
FIG. 1 is a perspective view of a cylinder head with a mounted air supply pipe piece.
Figure 2A:
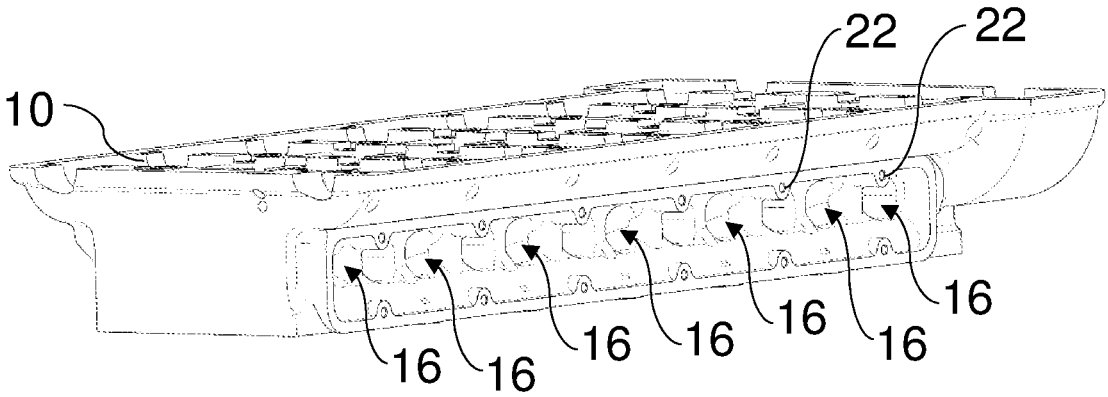
FIG. 2A is a perspective view of the cylinder head.
Figure 2B:
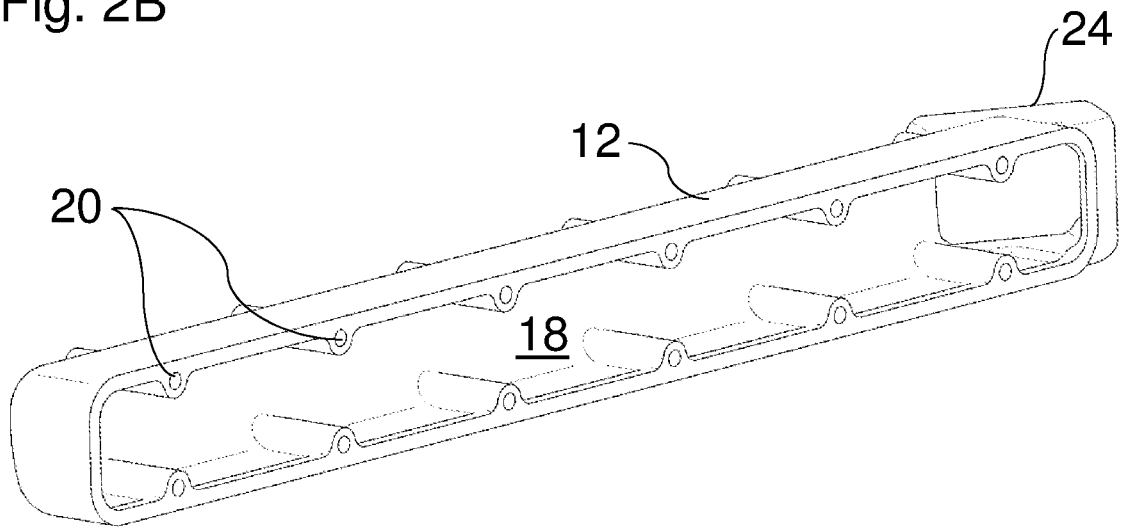
FIG. 2B is a perspective view of the air supply pipe piece.

FIG. 1 shows a cylinder head 10 and an air supply pipe piece 12 of an internal combustion engine which is not illustrated in greater detail. The internal combustion engine may, for example, be used to drive a utility vehicle. The utility vehicle may in particular be a bus or a lorry. The air supply pipe piece 12 is connected to the cylinder head 10. The cylinder head 10 and the air supply pipe piece 12 form an air inlet system 14. The air inlet system 14 may be a charge air system or a suction system. In FIG. 2A, the cylinder head 10 is illustrated without an air supply pipe piece 12. In FIG. 2B, the air supply pipe piece 12 is illustrated without the cylinder head 10.

The cylinder head 10 may be mounted for sealing one or more cylinders on an engine block of an internal combustion engine (not illustrated). In the embodiment illustrated, the cylinder head 10 is a multi-cylinder cylinder head which can be mounted on a plurality of cylinders which are arranged beside each other. Alternatively, the cylinder head may also be constructed as a single-cylinder cylinder head for a single cylinder.

As illustrated in FIG. 2A, the cylinder head 10 has a plurality of inlet channels 16 which in the assembled state lead to combustion chambers of the internal combustion engine. Through the inlet channels 16, inlet air (fresh air) is supplied to the combustion chambers. In some embodiments, recirculated exhaust gas and/or an air/fuel mixture can additionally be directed through the inlet channels 16 into the combustion chambers.

The inlet air is directed through an air supply channel 18 (see FIGS. 1 and 2B) to the inlet channels 16. The air supply channel 18 opens in the inlet channels 16. The air supply pipe piece 12 can be mounted on the cylinder head 10 by means of a plurality of screw connections. In detail, screws (not illustrated) can be guided through screw holes 20 in the air supply pipe piece 12 and screwed into corresponding receiving holes 22 in the cylinder head 10. For reasons of clarity, in FIGS. 1, 2A and 2B only two screw holes 20 and two receiving holes 22 are indicated.

The air supply channel 18 is formed between the cylinder head 10 and the air supply pipe piece 12. The air supply pipe piece 12 has to this end an open profile which fits together with an open profile on the cylinder head 10. In the embodiment shown, the open profile of the air supply pipe piece 12 is a U-shaped profile. Depending on the requirements and structural space, however, other profile shapes for the air supply pipe piece 12 are also conceivable.

In other embodiments, the air supply channel 18 can be formed completely by the air supply pipe piece 12. It is also possible for the air supply pipe piece 12 to be cast directly on the cylinder head 10. That is to say, the cylinder head 10 can be cast together with the air supply pipe piece 12 in one casting operation as an integral cast component. In this instance, the cylinder head 10 forms, for example, an outlet region of the air supply channel 18 which opens into the inlet channels 16.

The air supply channel 18 extends in a substantially linear manner in a longitudinal direction along (in a longitudinal direction of) the cylinder head 10. A path of the air supply channel 18 can be adapted to the arrangement of peripheral components, for example, in order to bypass the peripheral components. The air supply channel 18 is constructed as a distribution channel. From an inlet opening 24, the inlet air is directed from the air supply channel 18 to the plurality of inlet channels 16. The inlet opening 24 may be arranged at an end of the air supply pipe piece 12 and/or at any position between two ends of the air supply pipe piece 12. To this end, the air supply channel 18 may have a plurality of outlets for the plurality of inlet channels 16. That is to say, the air supply pipe piece 12 can be constructed as an air supply distribution pipe piece.

The air supply pipe piece 12 is constructed as a load-bearing element on which one or more additional components of the internal combustion engine can be mounted. The air supply pipe piece 12 is in particular produced from a metal alloy, for example, an aluminium alloy. The air supply pipe piece 12 may be a cast component, for example, a die-cast component.

The air inlet system 14 may additionally have a charge air cooler (not illustrated) and/or a compressor (not illustrated). The charge air cooler and the compressor may be arranged upstream of the inlet opening 24 of the air supply pipe piece 12 (of the air supply channel 18). The compressor may compress inlet air and, for example, be part of a turbocharger. The charge air cooler may, for example, cool inlet air heated by means of compression when flowing through.

In FIGS. 3 to 6, sectioned views through different charge air systems according to the present disclosure are illustrated. In this case, the plane of section is selected in such a manner that in each case a centre axis A of the inlet channel 16 extends in the plane of section.

Figure 3:
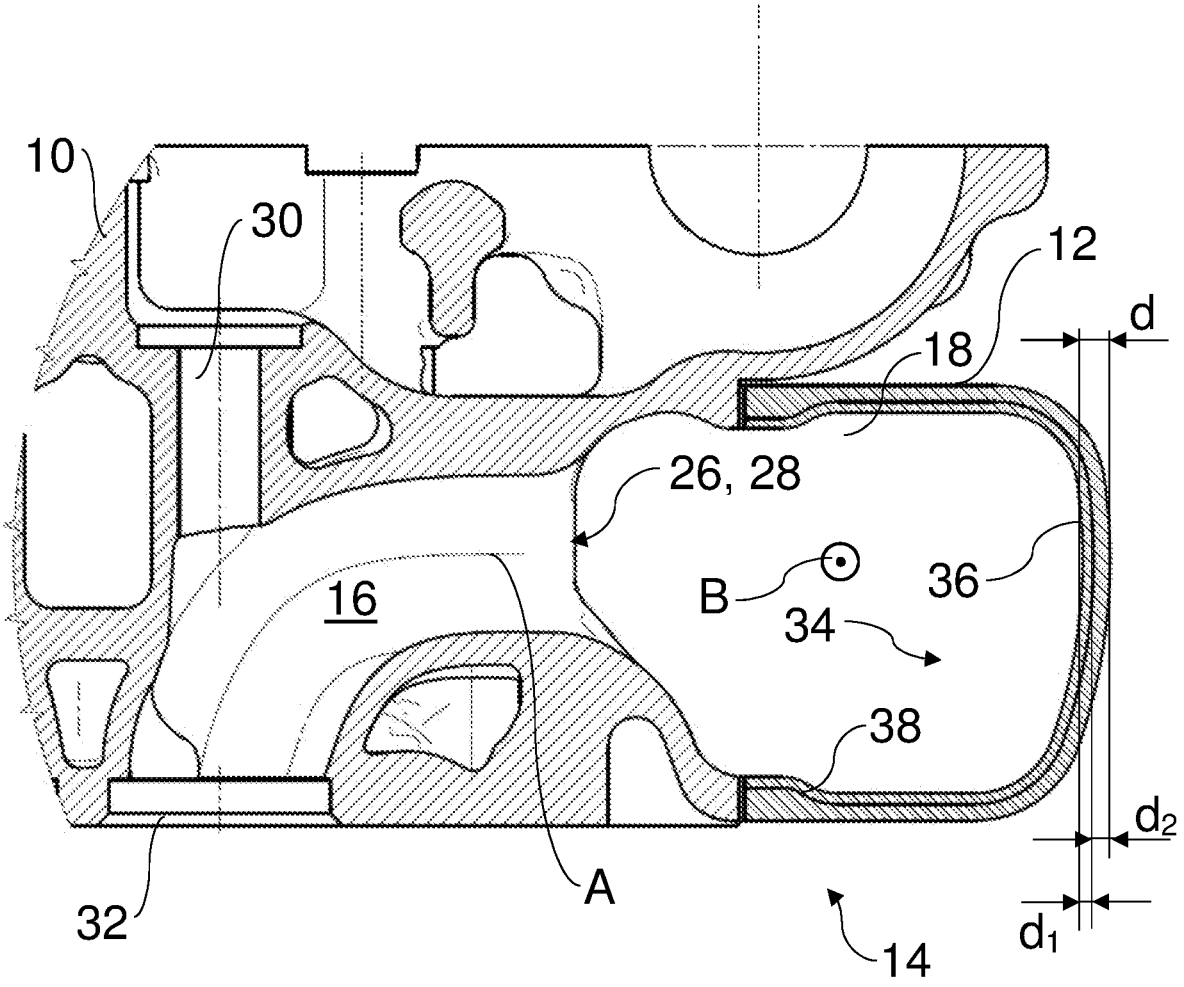
FIG. 3 is a sectioned view through the cylinder head and the air supply pipe piece in a first exemplary embodiment.

FIG. 3 shows an embodiment in which the cylinder head 10 and the air supply pipe piece 12 are constructed separately. In particular, the air supply pipe piece 12, as explained above with reference to FIGS. 1 to 2B, is screwed to the cylinder head 10.

The air supply channel 18 extends in a linear manner along a longitudinal axis B. The longitudinal axis B is substantially perpendicular to the centre axis A of the inlet channel 16. In particular, the longitudinal axis B is substantially perpendicular to all the centre axes A of a plurality of inlet channels 16.

The inlet air which flows in the air supply channel 18 flows through an outlet opening 26 of the air supply channel 18 into an inlet opening 28 of the inlet channel 16. Through the curved inlet channel 16, the air then flows into a combustion chamber. A globe valve (not illustrated), in particular a disc valve, may partially extend through the inlet channel 16. The globe valve is supported in a receiving member 30 and serves to open and close a combustion chamber opening 32 of the inlet channel 16.

Thermal insulation 34 is arranged in the air supply channel 18. The thermal insulation 34 reduces a heat transfer to the inlet air flowing through the air supply channel 18. The heat originates in particular from the cylinder head 10 which is heated during operation and the ambient air of the internal combustion engine which is heated during operation.

The thermal insulation 34 may be produced from a plastics material, for example, a thermoplastic, a rubber and/or a silicone. Silicones for automotive construction are in particular considered as silicones. It is possible to use as rubber, for example, FKM (fluorocarbon rubber) or FPM (fluoropolymer rubber).

The thermal insulation 34 is in particular produced from a different material from the air supply pipe piece 12. Whilst the air supply pipe piece 12 is constructed from a load-bearing material such as, for example, a metal with a high thermal conductivity, the thermal insulation 34 has a very low thermal conductivity. The thermal conductivity of the thermal insulation 34 is, for example, less than 5 W/(m·K), in particular less than 1 W/(m·K), preferably less than 0.1 W/(m·K).

The thermal insulation 34 may have a smooth surface in order to enable the most uniform possible flow through the air supply channel 18.

In the illustrated embodiment, the thermal insulation 34 has a coating 36. The coating 36 at least partially covers an inner wall face 38 of the air supply channel 18 (air supply pipe piece 12). The coating 36 may, for example, be applied by means of an injection method (for example, an injection moulding method). In an injection method, it is, for example, possible for a carbon-fibre-reinforced thermoplastic, for example, PA66-CF35, to be applied. Of course, other coating methods are also conceivable. Typically, the coating 36 is applied to the inner wall face 38 prior to assembly of the air supply pipe piece 12 on the cylinder head 10.

In the region of the air supply pipe piece 12, the air supply channel 18 has a wall thickness d. The wall thickness d is produced as the sum of the wall thickness (thickness) $d_1$ of the coating 36 (thermal insulation 34) and the wall thickness $d_2$ of the outer wall of the air supply pipe piece 12. The wall thickness $d_1$ of the coating 36 may, for example, be sized in such a manner that it is approximately in a range between 30% and 40% of the wall thickness d. The wall thickness of the thermal insulation 34 is in particular selected in such a manner that in actual fact an adequate thermally insulating effect is achieved.

Investigations have shown that such wall thicknesses for the thermal insulation (in the form of an inlay or a coating) enable a comparable thermal insulation to air supply pipe pieces which are produced, for example, completely from plastics material. These plastics material supply pipes may provide good thermal insulation but they are not load-bearing components on which other components of the internal combustion engine can be mounted.

Figure 4:
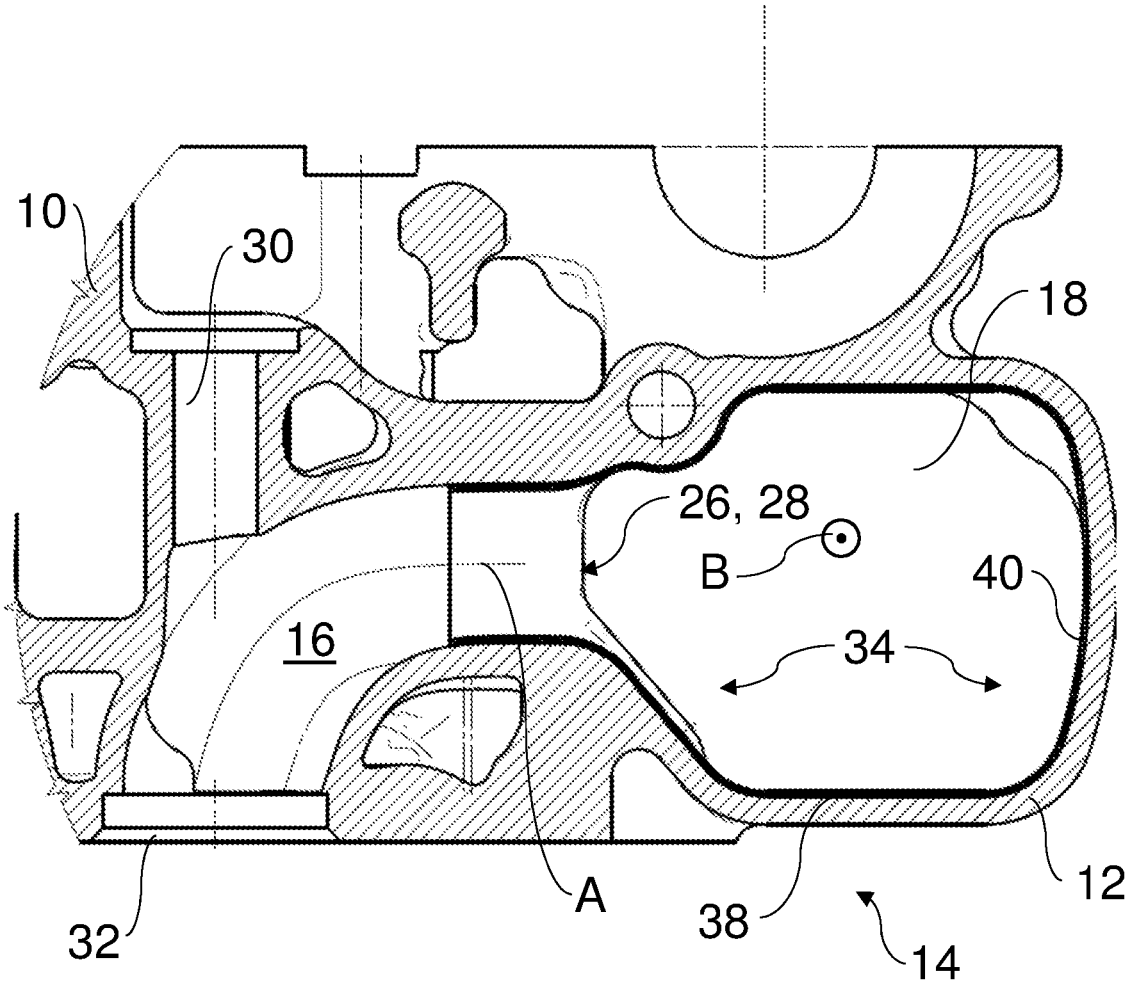
FIG. 4 is a sectioned view through the cylinder head and the air supply pipe piece in a second exemplary embodiment.

FIG. 4 shows an embodiment in which the cylinder head 10 and the air supply pipe piece 12 are constructed integrally as a cast component. The air supply pipe piece 12 is cast on the cylinder head 10. In particular, the air supply pipe piece 12 and the cylinder head 10 were formed in a common casting method.

In the embodiment illustrated, the thermal insulation 34 is constructed as an inlay 40 in the form of a liner. The inlay 40 is arranged in the air supply channel 18 and extends into the inlet channel 16. The inlay 40 is in abutment with the inner wall face 38. The inlay 40 may be constructed in one layer or with multiple layers. The inlay 40 may be constructed in one piece or in multiple pieces. In the embodiment illustrated, the inlay 40 extends partially into the inlet channel 16.

The inlay 40 may have an adhesive coating (adhesive layer) or a plurality of adhesive locations by means of which the inlay 40 is adhesively bonded to the inner wall face 38. The inlay 40 may also be secured to the inner wall by means of another suitable securing means. However, it is also possible to provide the inlay 40 without any adhesive layer or securing means, for example, when the inlay 40 is constructed in such a manner that it can be supported against the inner wall face 38. An outer contour of the inlay 40 reproduces a contour of the inner wall face 38 and is therefore applied to the inner wall face 38. With charged engines, there is during normal operation an excess pressure in the air supply channel 18. The excess pressure presses the inlay 40 onto the inner wall face 38 and prevents undesirable sliding of the inlay 40. With a closed throttle valve, however, even with charged engines, there may be a reduced pressure in the air supply channel 18 so that, in this instance, precautions should also be taken in order to prevent release of the inlay from the inner wall face.

The inlay 40 may be flexible so that it can in particular be folded. The inlay 40 may in the folded state be introduced through the combustion chamber opening 32 or the inlet opening 24 (see FIG. 1) into the air supply channel 18. In the air supply channel 18, the inlay 40 can be unfolded and abut the inner wall face 38.

The inlay 40 may also be used in embodiments in which the air supply pipe piece 12 is mounted on the cylinder head 10. In this instance, the inlay 40 can be placed in the air supply pipe piece 12 before the air supply pipe piece 12 is mounted. It is also possible for the inlay 40 to be introduced through the combustion chamber opening 32 or the inlet opening 34 (see FIG. 1) into the air supply channel 18 after the assembly of the air supply pipe piece 12.

In embodiments with a mounted air supply pipe piece 12, the inlay 40 may additionally be sized in such a manner that it covers an interface (a transition) between the cylinder head 10 and the air supply pipe piece 12. The inlay 40 can thus additionally act as a seal between the cylinder head 10 and the air supply pipe piece 12.

The inlay 40 may, for example, be produced using a 3D printing method. In such a 3D printing method, the inlay 40 may, for example, be printed as a thermoplastic polyurethane by a 3D printer.

Figure 5:
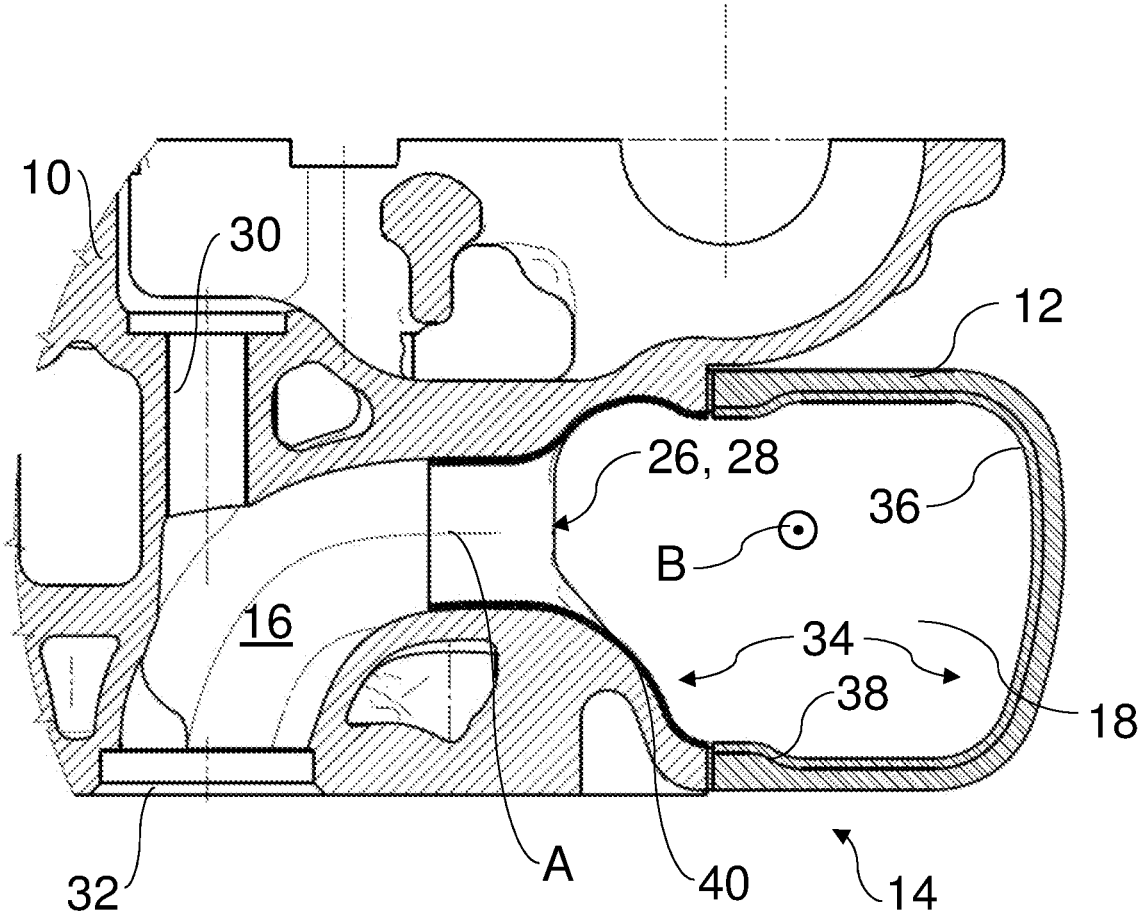
FIG. 5 is a sectioned view through the cylinder head and the air supply pipe piece in a third exemplary embodiment.

FIG. 5 shows another embodiment in which the thermal insulation 34 is additionally partially arranged in the inlet channel 16. In this instance, the insulation 34 is formed by means of a coating 36 and an inlay 40. The inlay 40 extends in an outlet region of the air supply channel 18 and partially in the inlet channel 16. The inlay 40 may in a similar manner to the inlay 40 be produced and positioned from the embodiment described with reference to FIG. 4. The inlay 40 may in particular be constructed in such a manner that it covers a contact region between the cylinder head 10 and the air supply pipe piece 12 for sealing (not illustrated).

In some embodiments, the thermal insulation 34 may additionally in the inlet channel 16 have a coating of an inner wall face of the inlet channel 16 and/or an inlay which is in abutment with an inner wall face of the inlet channel 16.

Figure 6:
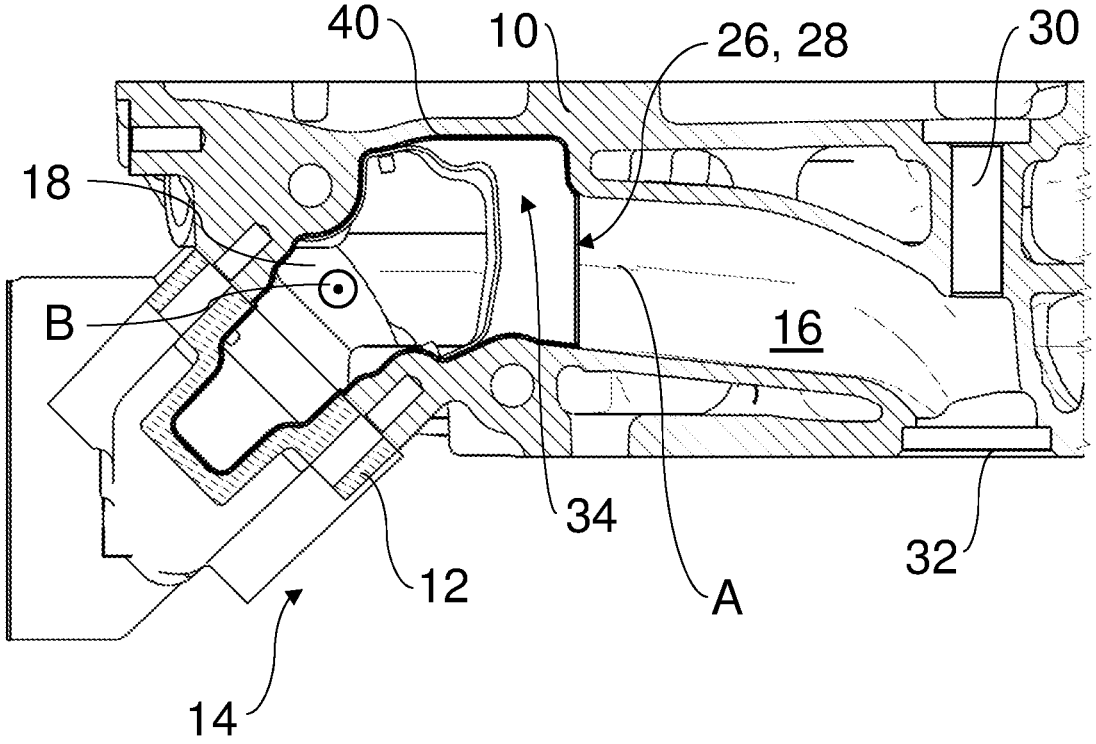
FIG. 6 is a sectioned view through a cylinder head and an air supply pipe piece in a fourth exemplary embodiment.

FIG. 6 shows another embodiment in which the thermal insulation 34 is formed by means of an inlay 40 which is arranged in the air supply channel 18. In the embodiment shown, the air supply pipe piece 12 is provided only as a type of cover which is screwed to the cylinder head 10. The air supply channel 18 is predominantly formed by the cylinder head 10. The inlay 40 may, for example, be introduced through the combustion chamber opening 32 or an inlet opening of the air supply channel 18 and be unfolded in the air supply channel 18 with an already assembled air supply pipe piece 12.

Those of ordinary skill in the art will recognise that the air inlet systems disclosed herein can use different methods for production which can be combined depending on the construction of the thermal insulation.

In an embodiment, in which the air supply pipe piece is cast on the cylinder head and the thermal insulation 34 has the inlay 40 (see FIG. 4), the inlay 40 can be introduced through the combustion chamber opening 32 or the inlet opening 24 into the air supply channel 18. To this end, the inlay 40 is folded before introduction. In the air supply channel 18, the inlay 40 is unfolded. The inlay 40 is then laid with the adapted outer contour thereof against the inner contour of the air supply channel 18.

In an embodiment in which the air supply pipe piece 12 is mounted on the cylinder head 10 and the thermal insulation 34 has the inlay 40 (see, for example, FIG. 6), the inlay 40 can be arranged before or after the assembly of the air supply pipe piece 12 on the cylinder head 10 in the air supply channel 18. In particular in embodiments in which the air supply channel 18 is completely or mainly constructed in the air supply pipe piece 12, the inlay 40 can be placed before the assembly of the air supply pipe piece 12 on the cylinder head 10 in the air supply pipe piece 12. In embodiments (see, for example, FIG. 6) in which the air supply channel 18 is formed between the air supply pipe piece 12 and the cylinder head 10, the inlay 40 can preferably be introduced through the combustion chamber opening 32 or the inlet opening 24 after the assembly of the air supply pipe piece 12 on the cylinder head 10.

In a construction variant in which the air supply pipe piece 12 is mounted on the cylinder head 10 and the thermal insulation 34 has the coating 36 (see, for example, FIG. 3), the coating 36 may in particular be applied before the assembly of the air supply pipe piece 12.

The disclosure is not limited to the embodiments described above. Instead, a large number of variants and modifications which also make use of the notion of the disclosure and therefore fall within the protective scope are possible. In particular, the disclosure also claims protection for the subject-matter and the features of the independent claims regardless of the claims which are referred to.

LIST OF REFERENCE NUMERALS

10 Cylinder head
12 Air supply pipe piece (air supply distribution pipe)
14 Air inlet system
16 Inlet channel
18 Air supply channel
20 Screw holes
22 Receiving holes
24 Inlet opening of the air supply channel
26 Outlet opening of the air supply channel
28 Inlet opening of the inlet channel
30 Receiving member for globe valve
32 Combustion chamber opening
34 Thermal insulation
36 Coating
38 Inner wall face of the air supply channel/air supply pipe piece
40 Inlay (liner)

The invention claimed is:

1. An air inlet system for an internal combustion engine comprising:
- a cylinder head having an inlet channel for introducing inlet air into a combustion chamber of the internal combustion engine;
- an air supply pipe piece, which is connected to the cylinder head and which at least partially forms an air supply channel, which opens in the inlet channel; and
- thermal insulation, which is arranged in the air supply channel in order to reduce a heat transfer to the inlet air which flows in the air supply channel, wherein the thermal insulation has an inlay which abuts an inner wall face of the air supply channel, wherein the inlay is constructed as a flexible solid inlay.

2. The air inlet system according to claim 1, wherein the air supply pipe piece and the thermal insulation are produced from different materials, wherein the air supply pipe piece is produced from a metal alloy, and the thermal insulation is produced from a plastics material.

3. The air inlet system according to claim 2, wherein the air supply pipe piece is produced from an aluminum alloy and the thermal insulation is produced from rubber or a silicone.

4. The air inlet system according to claim 1, wherein the thermal insulation has a thermal conductivity less than 1 W/(m·K).

5. The air inlet system according to claim 4, wherein the thermal insulation has a thermal conductivity less than 0.5 W/(m·K).

6. The air inlet system according to claim 5, wherein the thermal insulation has a thermal conductivity, less than 0.1 W/(m·K).

7. The air inlet system according to claim 1, wherein:
- the air supply pipe piece is mounted on the cylinder head or screwed on; or
- the air supply pipe piece and the cylinder head are constructed integrally with each other from one piece to form an integral cast component.

8. The air inlet system according to claim 1, wherein the inlay has an adhesive layer for adhesively bonding the inlay to the inner wall face of the air supply channel.

9. The air inlet system according to claim 8, wherein:
- the inlay is produced by means of a 3D printing method; or
- the inlay is additionally provided so as to act as a seal on a transition between the air supply pipe piece and the cylinder head.

10. The air inlet system according to claim 1, wherein the thermal insulation has a coating which is applied to an inner wall face of the air supply channel by means of an injection method.

11. The air inlet system according to claim 1, wherein the thermal insulation is constructed to damp a suction noise which occurs during operation of the internal combustion engine in the air suction channel or to acoustically insulate the suction channel.

12. The air inlet system according to claim 1, wherein:
- the thermal insulation is arranged in the inlet channel; and
- the thermal insulation in the inlet channel has a coating of an inner wall face of the inlet channel or an inlay which abuts the inner wall face and which is a flexible liner.

13. The air inlet system according to claim 1, wherein:
- the inlet channel is curved; or
- the air supply channel extends in a substantially linear manner; or
- the air supply channel is constructed as an air supply distribution channel with a plurality of outlets for a plurality of inlet channels; or
- the air supply pipe piece is constructed as a load-bearing element or as a cast component for mounting one or more components of the internal combustion engine.

14. The air inlet system according to claim 1, wherein:
- the cylinder head partially forms the air supply channel, and wherein the cylinder head forms an outlet region of the air supply channel which opens in the inlet channel; or
- the air supply pipe piece completely forms the air supply channel.

15. The air inlet system according to claim 1, wherein:
- the thermal insulation and the air supply pipe piece define a common wall thickness of the air supply channel; and
- the thermal insulation has a wall thickness in a range less than 50% of the common wall thickness.

16. The air inlet system according to claim 1, wherein the thermal insulation has a wall thickness in a range less than 30% and 40% of the common wall thickness.

17. The air inlet system according to claim 1, wherein the air inlet system is incorporated in a motor vehicle.

18. A method for producing an air inlet system of an internal combustion engine, comprising:

casting a cylinder head having an inlet channel and a cast air supply pipe piece, which with the cylinder head forms an air supply channel which opens in the inlet channel, wherein the inlet channel has a combustion chamber opening and the air supply channel has an inlet opening;

introducing thermal insulation which has a folded inlay liner, through the combustion chamber opening or the inlet opening into the air supply channel, wherein the folded inlay is constructed as a flexible solid inlay; and unfolding the inlay in the air supply channel so that the inlay is in abutment with an inner wall face of the air supply channel.

19. A method for producing an air inlet system of an internal combustion engine, comprising:

casting an air supply pipe piece for mounting on a cylinder head so that an air supply channel which is at least partially formed by the air supply pipe piece opens in an inlet channel of the cylinder head;

placing or introducing an inlay as thermal insulation liner in the air supply channel, wherein the inlay is constructed as a flexible solid inlay; and mounting the air supply pipe piece on the cylinder head.

* * * * *